US007212167B2

(12) United States Patent
Leelaratne et al.

(10) Patent No.: US 7,212,167 B2
(45) Date of Patent: May 1, 2007

(54) INTEGRATED LOOP ANTENNA FOR VEHICULAR APPLICATIONS

(75) Inventors: Dedimuni Rusiru Vinodaka Leelaratne, Kent (GB); Peter Callaghan, Kent (GB); John Randall, Kent (GB)

(73) Assignee: Harada Industry Co., Ltd., Kent (GB)

( * ) Notice: Subject to any disclaimer, the term of this patent is extended or adjusted under 35 U.S.C. 154(b) by 0 days.

(21) Appl. No.: 10/522,220

(22) PCT Filed: Jul. 24, 2003

(86) PCT No.: PCT/GB03/03260

§ 371 (c)(1),
(2), (4) Date: Sep. 29, 2005

(87) PCT Pub. No.: WO2004/010529

PCT Pub. Date: Jan. 29, 2004

(65) Prior Publication Data

US 2006/0097934 A1 May 11, 2006

(30) Foreign Application Priority Data

Jul. 24, 2002 (GB) ..... 0217157.7

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS

| | | | | |
|---|---|---|---|---|
| 3,766,563 | A * | 10/1973 | Sauer et al. | 343/713 |
| 3,771,159 | A | 11/1973 | Kawaguchi et al. | |
| 5,565,876 | A | 10/1996 | Murakami et al. | |
| 6,160,518 | A | 12/2000 | Shibata et al. | |

FOREIGN PATENT DOCUMENTS

| | | |
|---|---|---|
| DE | 40 00 381 A | 7/1991 |
| DE | 197 26 949 A | 1/1998 |
| EP | 0 155 647 A2 | 3/1985 |
| EP | 0 806 808 A | 11/1997 |
| EP | 0 854 533 A | 7/1998 |
| JP | 48/132005 | 11/1973 |

* cited by examiner

*Primary Examiner*—Michael C. Wimer
(74) *Attorney, Agent, or Firm*—Dickstein Shapiro LLP

(57) ABSTRACT

A vehicular screen antenna includes a conductor extending on a dielectric, such as a window. The conductor is configured as a loop having entry and exit segments, the loop being positioned generally centrally on the dielectric. The entry and exit segments extend proximate each other from the loop towards a first edge of the dielectric and are oriented on the dielectric so as to extend generally vertically when the dielectric is fitted to a vehicle.

19 Claims, 5 Drawing Sheets

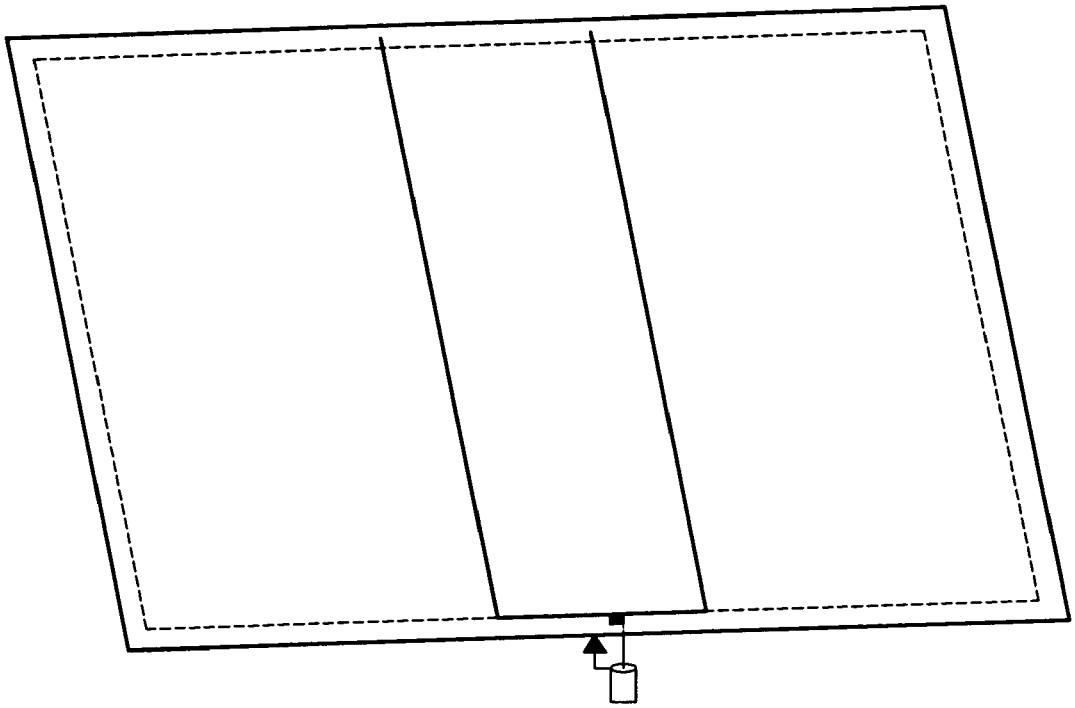
*Fig. 1* *Prior Art*
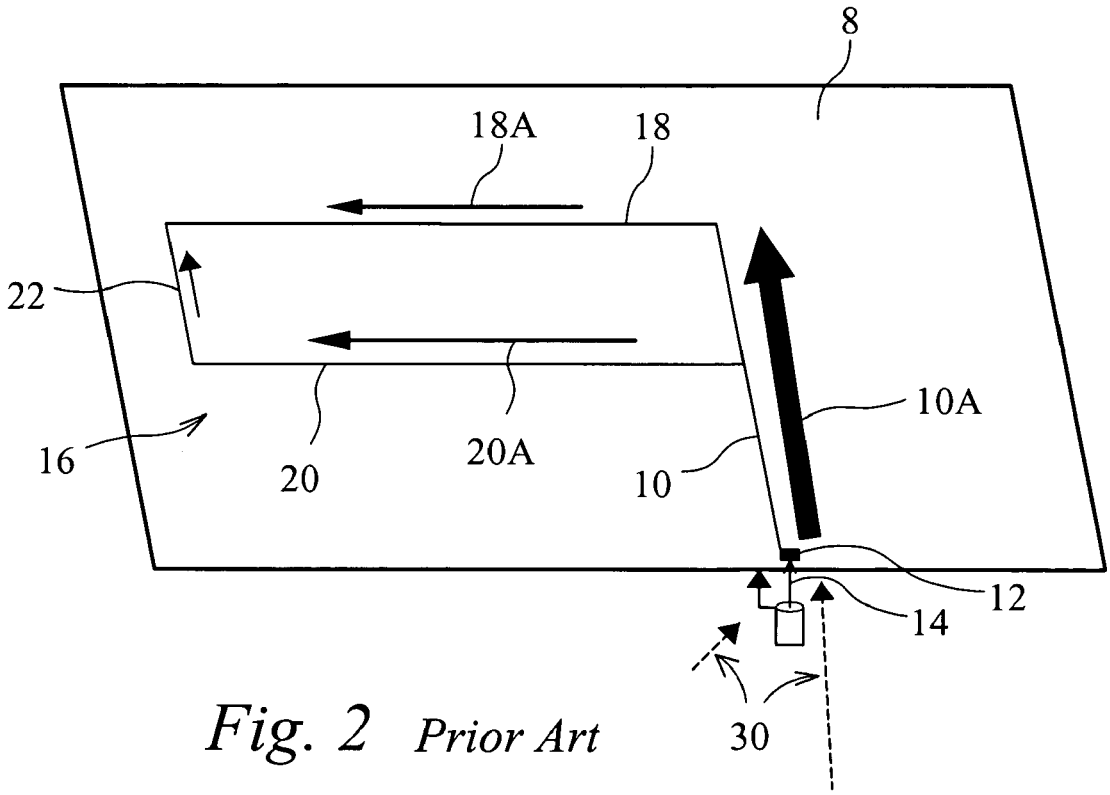
*Fig. 2* *Prior Art*

INTEGRATED LOOP ANTENNA FOR VEHICULAR APPLICATIONS

BACKGROUND OF THE INVENTION

The present invention relates to a vehicular antenna system and, more particularly, to a system that includes a configuration for a loop antenna which enhances reception performance.

Antennas integrated into parts of a vehicle are known. One approach is to use the de-misting heater grid on the rear screen as part of the antenna; see Japanese Patent Application No. 48-132005. Such an arrangement may be used with a separate element for AM reception; see EP Patent Application No. 0 155 647.

Some vehicles provide a suitable dielectric surface onto which a dedicated antenna element pattern can be formed. One example is the rear quarter window on a station wagon (estate car). Such windows are fixed, which allows the printing of a suitable antenna pattern. For example, the use of separate patterns to provide FM and AM radio reception was proposed in U.S. Pat. No. 3,771,159. Combining a pattern on a side window with elements on other windows to improve pattern coverage was proposed in EP Application No. 0 854 533.

A major problem with implementation of an antenna element on a rear quarter window of a vehicle is polarisation. Often the signal feedline needs to connect to the bottom of the window because of space limitations at the top and sides of the window frame. This means that the primary antenna currents are extending vertically, and there then exists correspondingly less horizontal polarisation ("horizontal polarisation" here signifying the horizontally-polarized component of the antenna signal). This causes problems for markets where broadcast signals are predominantly horizontally-polarised.

SUMMARY OF THE INVENTION

The present invention is a loop-type screen antenna that at least in its preferred embodiments is intended to address the foregoing problems.

A vehicular screen antenna of the invention is adapted to be fitted to a vehicle so as to extend generally vertically, and includes a conductor extending on a dielectric. The conductor is configured as a loop having entry and exit segments that extend proximate each other from the loop towards an edge of the dielectric and are oriented on the dielectric so as to extend generally vertically when the dielectric is fitted to a vehicle. During use of the antenna, a horizontally-polarized component of a linearly-polarized signal on the antenna has a magnitude at least approximating that of a vertically-polarized component of the signal. The words "generally vertically" are intended to be interpreted broadly herein to mean "at a substantial angle to the horizontal".

Preferably, the entry and exit segments join the loop proximate each other and a corner of the loop.

Preferably, when the dielectric is fitted to the vehicle, the first edge of the dielectric is a bottom edge. In such arrangement, the entry and exit segments may join the loop proximate each other and a corner of the loop.

Preferably, the dielectric is a window of the vehicle.

In a first embodiment, at the first edge of the dielectric the entry segment may be adapted to connect to a feedline, and the exit segment adapted to connect to vehicle ground.

In a second embodiment, at the first edge of the dielectric the entry segment may be adapted to connect to a feedline, and the exit segment to connect to a stub segment that extends generally parallel to the first edge of the dielectric for capacitive coupling to vehicle ground. In this embodiment, the stub segment may be adapted to be separated less than approximately 5 mm from a vehicle ground surface proximate the first edge of the dielectric. The length of the stub segment and its separation distance from the vehicle ground surface may be selected such that the stub segment is able to receive low-frequency broadcast signals (LW/MW/SW) typically described as "AM" (below 6 MHz).

In a third embodiment, at the first edge of the dielectric the entry segment may be adapted to connect to a feedline, and the exit segment to connect to one end of resonator circuitry the other end of which connects to vehicle ground. The resonator circuitry may be formed by a discrete electronic circuit that includes an inductor means and a capacitor means connected in series. The resonator circuitry may also include a tuning means.

Preferably, the antenna includes a switch means for disconnecting the exit segment from a signal ground and connecting it instead to the entry segment.

The loop may have a generally rectilinear configuration. Preferably, the loop is generally configured as a rectangle having its longer sides extending generally horizontally when the dielectric is fitted to the vehicle. More preferably, when the dielectric is fitted to the vehicle, the loop is extends at between approximately 50 mm and approximately 100 mm from the edges of the dielectric.

The loop may be positioned generally centrally on the dielectric.

Preferably, the dielectric is a rear window or a rear quarter window of a station wagon. More preferably, a signal feedline connectable to the entry segment is positioned on the body of the vehicle so as to be below a body aperture adapted to receive the respective rear window or rear quarter window and so as to be proximate a corner of the vehicle body.

The antenna of the subject invention is what is known in the art as an "electrically small" antenna, meaning that the operative length of the antenna is less than one-half wavelength of received signals. The antenna of the preferred embodiments of the invention is particularly intended for broadcast frequency-modulated ("FM") signal reception, and more generally for handling signals with wavelengths 5 to 10 times the operative antenna length, which brings this antenna well within the classification of an electrically-small antenna. Electrically-small antennas are adapted to receive or transmit signals having vertical and/or horizontal polarization rather than circularly-polarized signals.

BRIEF DESCRIPTION OF THE DRAWINGS

Preferred features of the present invention will now be described, by way of example only, with reference to the accompanying drawings, in which:

FIG. 1 illustrates a pattern of a first conventional screen antenna;

FIG. 2 illustrates a pattern of a second conventional screen antenna, and current flow in the antenna;

DETAILED DESCRIPTION OF THE PREFERRED EMBODIMENTS

Figure 3:
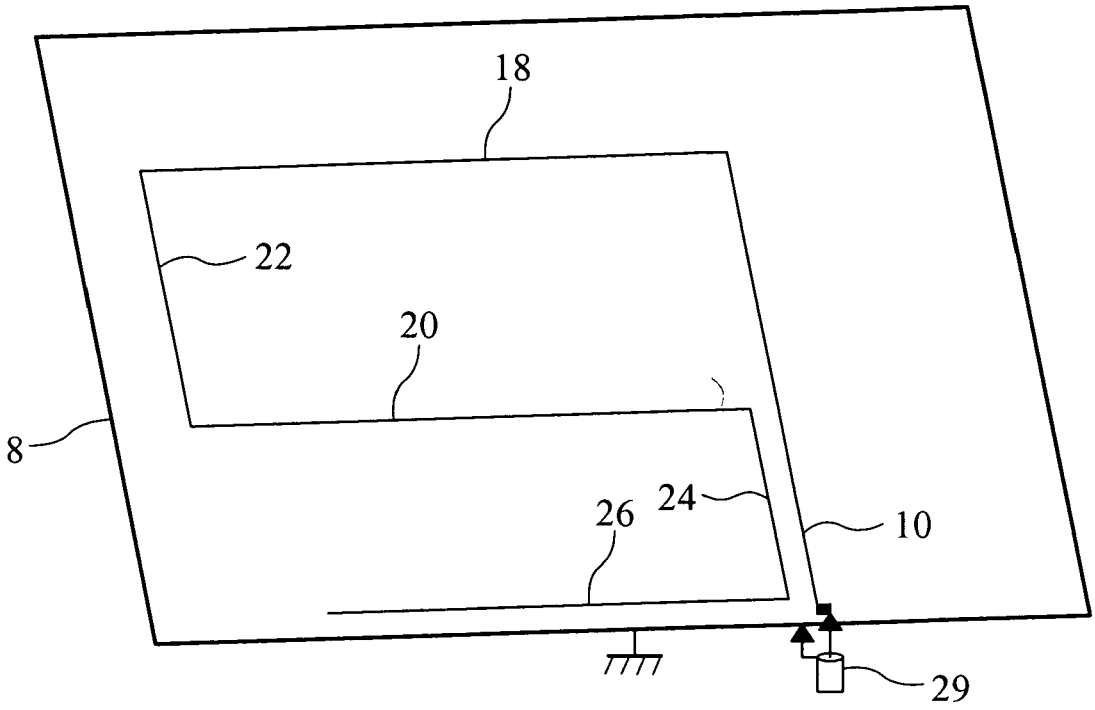
FIG. 3 illustrates a first embodiment of a screen antenna of this invention, the antenna including a stub ground element for a coupled ground connection.

One conventional type of screen antenna has an antenna element formed on a dielectric surface in an aperture of a vehicle body, as illustrated in FIG. 1. The dielectric is normally a window. The antenna element is a simple monopole-type, fed at its base. The antenna currents are split equally between the antenna element and the car body. When such an antenna element is used on a rear quarter window, greatest-magnitude currents flow mainly vertically, resulting in an antenna with predominantly-vertical polarisation.

Another conventional type of screen antenna has an antenna element formed on a surface of a dielectric 8, as illustrated in FIG. 2. In this case, a vertical feed wire 10 extends upward from a feed connection point 12 with a signal feedline 14 on the vehicle body to form one end of a closed loop generally designated 16. The loop 16 further consists of a pair of generally-parallel horizontal wires 18 and 20, and a vertical wire 22 forming the other end of loop 16. This can operate at VHF frequencies and can also provide an AM element; however, the VHF performance for horizontal polarisation is not good. This is because this configuration can be considered equivalent to a simple L-shaped element having a vertical segment connecting to a horizontal segment that extends to the left, with the left end being an open free end. The current diminishes toward the free end, and as such, the currents 18A and 20A along the horizontal wires 18 and 20 are small compared with the current 10A on the vertical feed wire 10; poor horizontal polarisation is the result.

Comparing the conventional structure of FIG. 2 with the loop arrangement of the subject invention shown in FIG. 3, it can be seen that the invention consists of opening the loop and adding to lower horizontal wire 20 another vertical wire 24 that is closely spaced to feed wire 10. The wire 24 in one embodiment of the invention connects to a stub antenna element 26 extending along the edge of the window, less than 5 mm from the vehicle body. The length of the stub antenna element 26 is adjusted to give a low impedance at the feed point and at the centre frequency of the VHF band of interest. An unbalanced transmission line, such as formed by a coaxial cable 29, feeds the antenna as shown in FIG. 3. The stub antenna element 26 is isolated from the rest of the antenna at low frequencies, enabling its use as an AM antenna (where "AM" here connotes low-frequency broadcast signals (LW/MW/SW) having a frequency below approximately 6 MHz).

Although the elements of the antenna loop have been described as being essentially horizontal and vertical, they might be angled for styling without major detriment. The antenna loop should be spaced away from the vehicle body to reduce excessive capacitive loading, yet be made as large as possible to increase bandwidth and reduce impedance. The separation between loop and car body needs to be optimized for each application, but is typically 50 mm to 100 mm.

Figure 4:
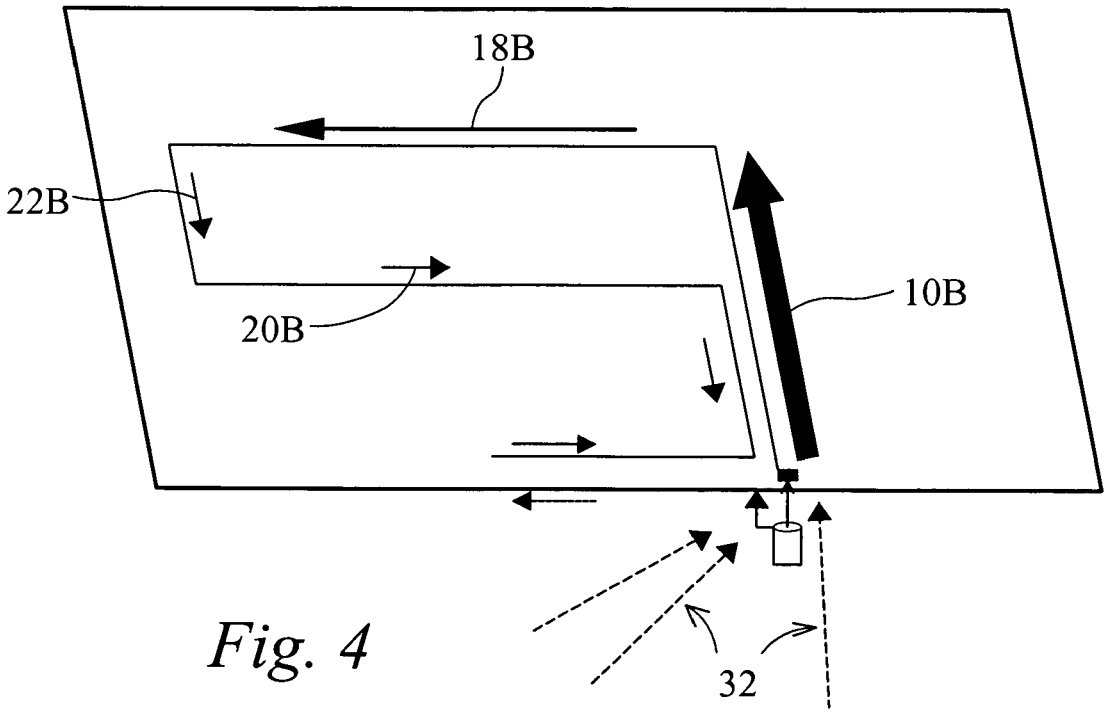
FIG. 4 illustrates current flow in the first embodiment of the screen antenna of this invention.

Typical resulting currents are shown in FIG. 4. The current 18B along the wire 18 is much greater than the current 18A of the closed loop of FIG. 2, with a resultant increase in horizontal polarisation. As in FIG. 2, the current diminishes with distance from signal feedline 14; however, the distance has now been increased by introducing a return path to ground. Currents 10B and 18B are of comparable magnitude, but are each larger than the currents 22B, 20B and 24B on the respective return wires 22, 20 and 24.

The excitation current of the loop element of the invention is actually a combination of two current modes. The first current mode is the "odd" mode, which is similar to the conventional element of FIG. 2, in which the return current to ground is zero. The second current mode is an "even" mode, whereby the current returning to ground connection point 26 is equal to the feed current. The net effect is a combination of two modes, and the combination will depend upon the physical structure and upon the wavelength of operation. Additionally, radiation also depends upon the "image" currents that flow in the body of the vehicle, close to connection point 12; however, such image currents are determined by the current structure on the element. The image currents 30 in the conventional case shown in FIG. 2 are essentially vertical, whereas the image currents 32 for the loop antenna of the subject invention, shown in FIG. 4, have a more two-dimensional nature, i.e. both horizontal and vertical.

Figure 5:
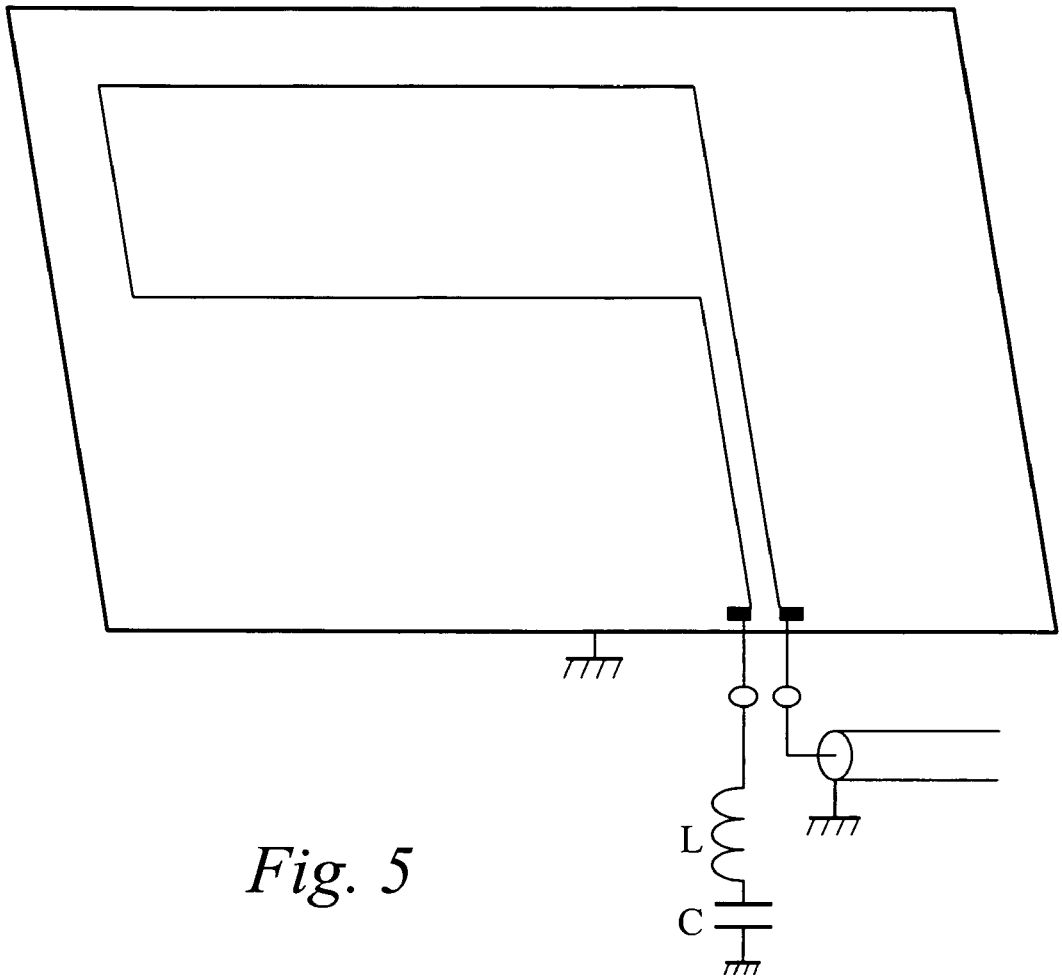
FIG. 5 illustrates a second embodiment of the screen antenna of this invention, the antenna including resonator circuitry at the ground connection.

A second embodiment of the invention is illustrated in FIG. 5. In this embodiment, the stub antenna 26 is not present, and the end of vertical wire 24 is connected to ground through a discrete series resonant circuit. The circuit is illustrated in FIG. 5 by an inductor L connected in series with a capacitor C, but any resonator element with similar properties might be used. This configuration maintains the VHF performance but also allows AM reception, i.e. the resonator element gives an 'open circuit' at AM. The discrete series resonant circuit might include circuitry to allow variable tuning for wider bandwidth.

Figure 6:
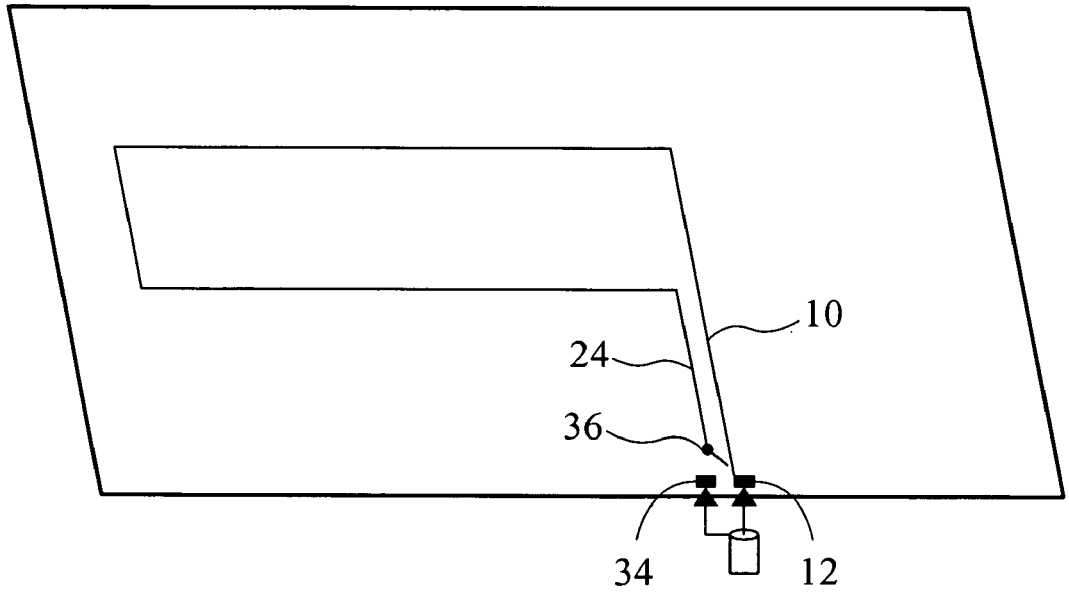
FIG. 6 illustrates a third embodiment of the screen antenna of this invention, the antenna having a direct ground connection and no stub ground element.

If AM reception is not required, then stub antenna element 26 is not present. This is a third embodiment of the invention, illustrated in FIG. 6, in which a direct connection is made between return line 24 and a ground connection point 34 on the vehicle body, proximate to the feed connection point 12. This embodiment (as well as the other two) may include an electronic switch 36 (shown schematically in FIG. 6) for connecting return wire 24 with the feed line rather than the ground line. After such switching, the antenna operates in a similar way to the L-shaped antenna shown in FIG. 2. Thus, the inclusion of the switch 36 allows a switched performance for polarisation diversity, i.e. reducing the horizontal polarisation while maintaining the vertical polarisation.

It has been found that if the loop antenna of the invention is placed in the rear quarter window of a car, improved omni-directionality can be obtained by placing the feed point to the rear. Horizontal components of the ground current can then flow onto the rear of the vehicle body, below the window, and these enhance the horizontal component in the plane orthogonal to the window, thereby achieving good omni-directionality for both horizontal and vertical polarisation.

Figure 7:
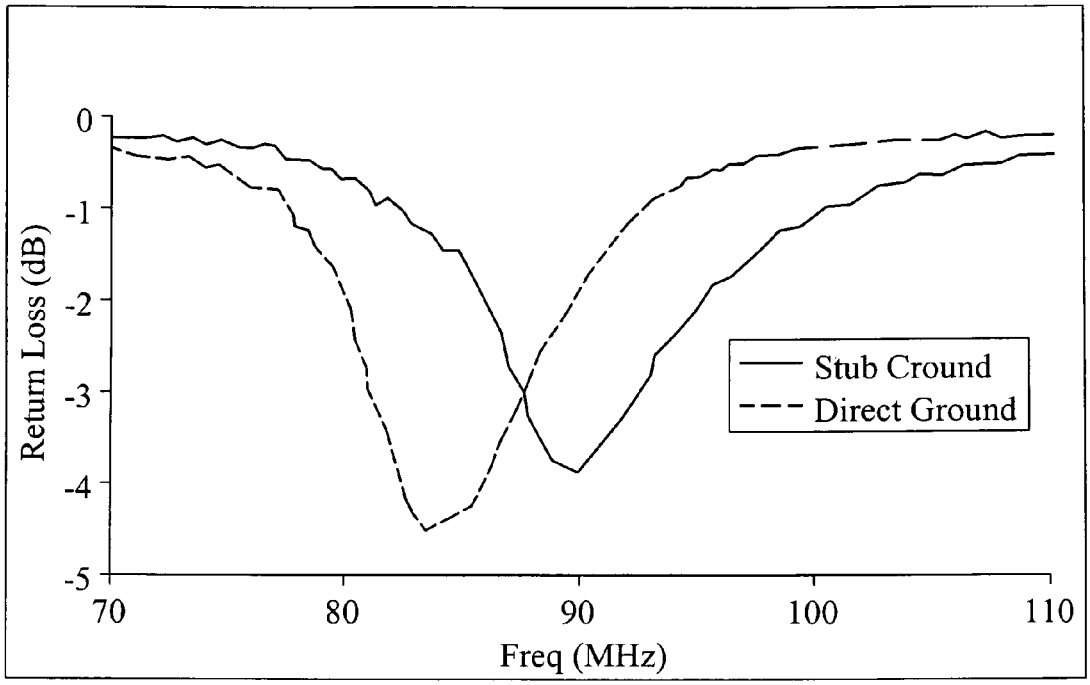
FIG. 7 is a graph comparing return loss for the loop antenna of FIG. 3 (coupled ground connection) and the loop antenna of FIG. 6 (direct ground connection)
Figure 8:
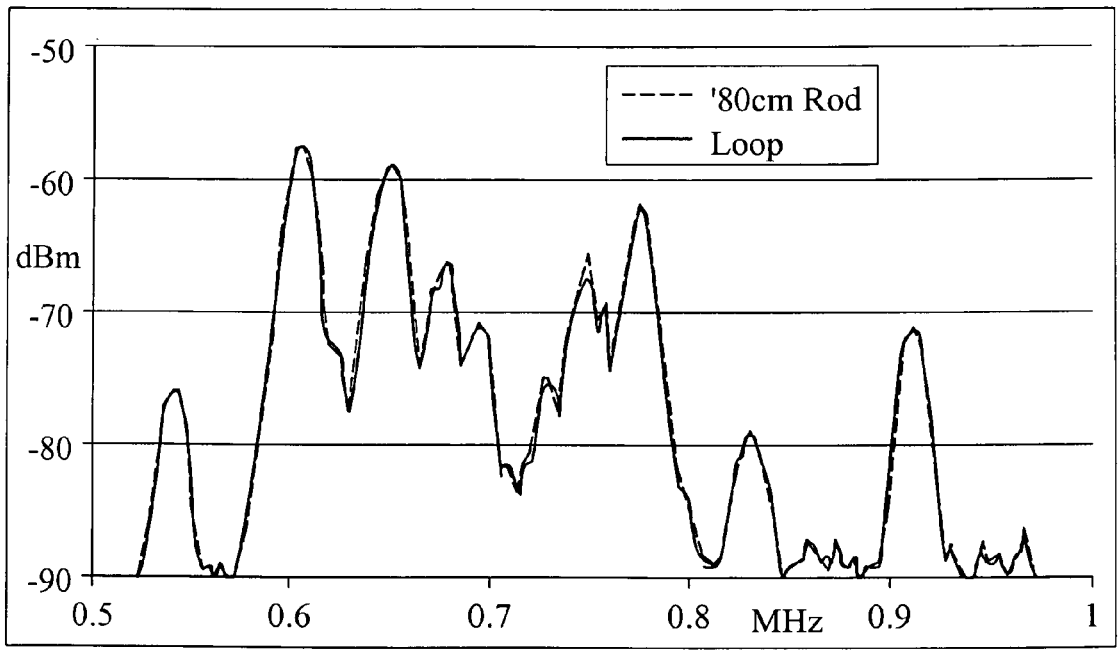
FIG. 8 is a graph comparing the sensitivity of a loop antenna with that of a rod antenna for AM signal reception; and, FIGS. 9(*a*) and 9(*b*) are polar diagrams illustrating vertically-polarised and horizontally-polarised VHF signal reception, respectively, for the antenna element of the subject invention in comparison to a conventional antenna element.

Practically, the length of the antenna element on the dielectric is less than a wavelength, i.e. is less than the resonant length. This translates to a narrower bandwidth, as illustrated in the return loss graph of FIG. 7; it is, however, wide enough for typical FM reception bandwidths, although some additional matching may be needed. The effect of using a coupled ground (stub antenna element 26 is present) is shown compared with using a direct ground. It can be seen that the stub antenna element performs well, with similar characteristics to the direct ground connection (a small amount of detuning is caused by the reactance of the stub). This is illustrated in FIG. 8, using a high-impedance amplifier to buffer the element. The coupled ground can be optimized to tune the VHF receive band and to minimize the capacitive loading for AM reception.

Figure 9A:
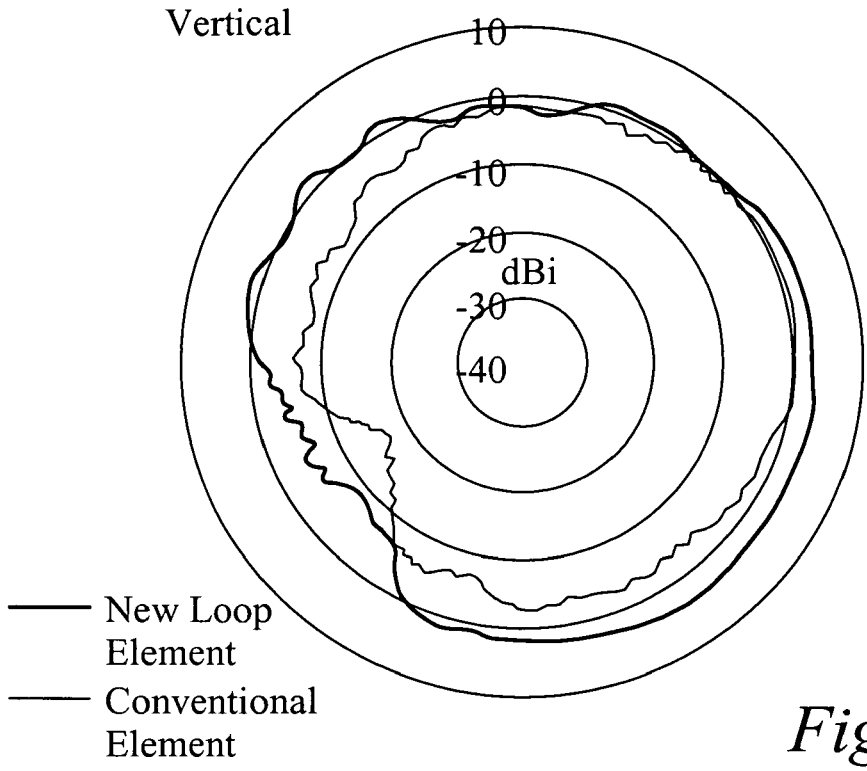
Figure 9B:
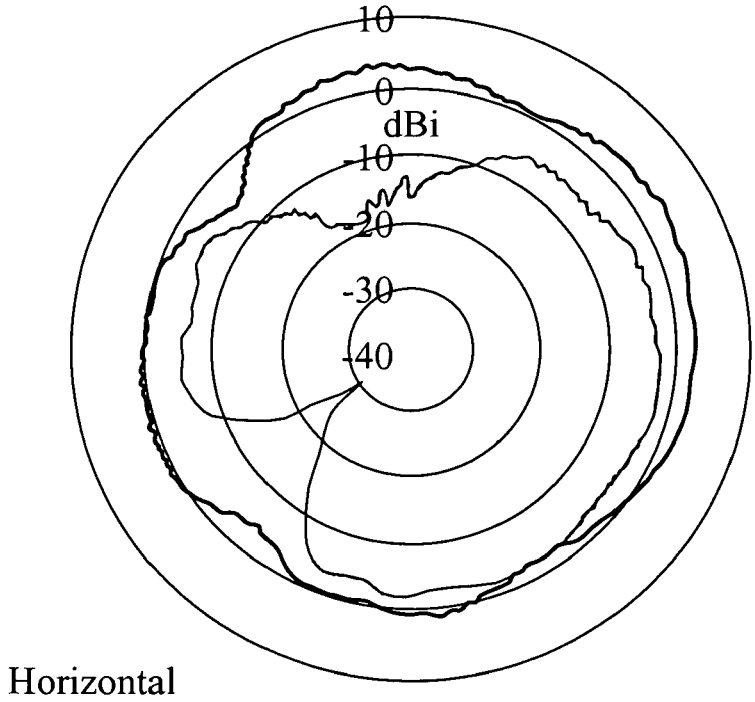

FIGS. 9(*a*) and 9(*b*) illustrate typical polar diagrams for screen antennas printed on the rear quarter window of a station wagon. Measurement is made at 98 MHz for both vertical and horizontal polarisations, using the proposed loop element of FIG. 3 against the conventional loop element of FIG. 2. An active matching circuit was used in both instances, providing around 5 dB of gain to each antenna (with received levels recorded in dBi). As expected, in the vertical plane the new open-loop element performs similarly to a conventional closed-loop element. However, for the horizontal plane the conventional closed-loop element is seen to have a poor horizontal component, while the new open-loop element is more omni-directional and provides greater horizontally-polarised gain, comparable to gain in the vertical plane.

While the present invention has been described in its preferred embodiments, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

The text of the abstract filed herewith is repeated here as part of the specification.

A vehicular screen antenna includes a conductor extending on a dielectric, such as a window. The conductor is configured as a loop having entry and exit segments, the loop being positioned generally centrally on the dielectric. The entry and exit segments extend proximate each other from the loop towards a first edge of the dielectric and are oriented on the dielectric so as to extend generally vertically when the dielectric is fitted to a vehicle.

The invention claimed is:

1. A vehicular screen antenna comprising a dielectric sheet and a conductor extending on the sheet, a portion of the conductor being generally configured as a rectilinear loop with edges extending generally parallel to the edges of the sheet, the sheet being adapted to be fitted to a vehicle so as to extend generally vertically, the conductor also having a loop-entry segment and a loop-exit segment extending proximate each other on the sheet and being oriented on the sheet such that, after fitting of the sheet to the vehicle, the segments extend generally vertically and have first ends connected to proximate spaced positions on the loop and second ends positioned proximate a first edge of the sheet, the second end of the loop-entry segment being connectable to a signal feedline and the second end of the loop-exit segment being connectable to ground through reactive coupling;

wherein the loop and segments are relatively sized such that, during operation of the antenna, a horizontally-polarized component of a linearly-polarized signal on the antenna has a magnitude at least approximating that of a vertically-polarized component of the signal.

2. The screen antenna of claim 1, wherein the conductor further comprises a stub segment connected to the second end of the loop-exit segment, the stub segment extending generally parallel to the first edge of the sheet for capacitive coupling to vehicle ground after fitting of the sheet to the vehicle.

3. The screen antenna of claim 1, wherein the second end of the loop-exit segment is adapted to connect, after fitting of the sheet to the vehicle, to one end of resonator circuitry the other end of which is connectable to vehicle ground.

4. The screen antenna of claim 1, wherein the second end of the loop-exit segment is alternatively connectable, by means of a switch, to the second end of the loop-entry segment.

5. The screen antenna of claim 2, wherein the second end of the loop-exit segment is alternatively connectable, by means of a switch, to the second end of the loop-entry segment.

6. The screen antenna of claim 3, wherein the second end of the loop-exit segment is alternatively connectable, by means of a switch, to the second end of the loop-entry segment.

7. The screen antenna of claim 1, wherein the first ends of the loop-entry and loop-exit segments are connected to the loop proximate a corner of the loop.

8. The screen antenna of claim 2, wherein the first ends of the loop-entry and loop-exit segments are connected to the loop proximate a corner of the loop.

9. The screen antenna of claim 3, wherein the first ends of the loop-entry and loop-exit segments are connected to the loop proximate a corner of the loop.

10. The screen antenna of claim 2, wherein the stub segment extends on the sheet such that, after fitting of the sheet to the vehicle, the stub segment is separated by less than approximately 5 mm from a vehicle ground surface proximate the first edge of the sheet.

11. The screen antenna of claim 10, wherein the length of the stub segment and its separation distance from the vehicle ground surface are selected such that the stub segment is able to receive low-frequency broadcast signals.

12. The screen antenna of claim 3, wherein the resonator circuitry is a discrete electronic circuit comprising an inductor means connected in series with a capacitor means.

13. The screen antenna of claim 12, wherein the resonator circuitry also includes a tuning means.

14. The screen antenna of claim 1, wherein the loop is generally configured as a rectangle having its longer sides extending generally horizontally when the sheet is fitted to the vehicle.

15. The screen antenna of claim 14, wherein one of the shorter sides of the loop is connected to, and is in-line with, the loop-entry segment.

16. The screen antenna of claim 1, wherein, when the sheet is fitted to the vehicle, the edges of the loop extend at between approximately 50 mm and approximately 100 mm from edges of the sheet.

17. The screen antenna of claim 1, wherein the loop is positioned generally centrally on the sheet.

18. The screen antenna of claim 1, wherein the sheet is a rear window or rear quarter window of a station-wagon type of vehicle.

19. The screen antenna of claim 18, wherein the screen antenna is adapted to be fitted to a vehicle in which the signal feedline is positioned on the body of the vehicle so as to be below a body aperture adapted to receive the respective rear window or rear quarter window and so as to be proximate a corner of the vehicle body.

* * * * *